US005980362A

United States Patent [19]

Hensler

[11] Patent Number: 5,980,362

[45] Date of Patent: Nov. 9, 1999

[54] STENCIL FOR USE IN SANDBLASTING STONE OBJECTS

[75] Inventor: Connie Hensler, Kennesaw, Ga.

[73] Assignee: Interface, Inc., Atlanta, Ga.

[21] Appl. No.: 09/031,615

[22] Filed: Feb. 27, 1998

[51] Int. Cl.[6] ..... B24B 1/00

[52] U.S. Cl. ..... 451/29; 451/31

[58] Field of Search ..... 451/442, 29, 30, 451/31

[56] References Cited

U.S. PATENT DOCUMENTS

| | | | |
|---|---|---|---|
| 2,162,332 | 6/1939 | Frick | 41/39 |
| 2,393,668 | 1/1946 | Wartha | 41/39 |
| 3,194,153 | 7/1965 | Rogerson . | |
| 3,267,621 | 8/1966 | Meyers et al. . | |
| 3,295,263 | 1/1967 | Savoca et al. | 51/262 |
| 3,473,941 | 10/1969 | Hemphil . | |
| 3,507,740 | 4/1970 | Gaspari | 161/167 |
| 3,526,064 | 9/1970 | Spidell, Jr. | 51/262 |
| 4,528,306 | 7/1985 | Shigehiro et al. | 523/219 |
| 4,702,786 | 10/1987 | Tallman . | |
| 4,716,096 | 12/1987 | Cooper et al. . | |
| 4,764,449 | 8/1988 | Vanlseghem . | |
| 4,801,490 | 1/1989 | Schuette . | |
| 4,828,893 | 5/1989 | Tallman . | |
| 5,197,234 | 3/1993 | Gillenwater | 51/310 |
| 5,319,028 | 6/1994 | Nakamura et al. | 525/227 |
| 5,350,550 | 9/1994 | Kitazawa et al. | 264/45.1 |
| 5,399,421 | 3/1995 | Cascino | 428/261 |
| 5,424,363 | 6/1995 | Nagata et al. | 525/85 |
| 5,512,005 | 4/1996 | Gulling . | |

*Primary Examiner*—David A. Scherbel
*Assistant Examiner*—Dung Van Nguyen
*Attorney, Agent, or Firm*—Kilpatrick Stockton, LLP; John S. Pratt

[57] ABSTRACT

A stencil for use in sandblasting stone objects having a polyvinyl chloride (PVC) layer cast onto a polyester liner. The formulation of the PVC layer comprises about 120 parts phthalate plasticizer and about 30 parts filler (typically calcium carbonate) per 100 parts resin.

14 Claims, 1 Drawing Sheet

STENCIL FOR USE IN SANDBLASTING STONE OBJECTS

BACKGROUND OF THE INVENTION

Engraving or etching words or images in stone objects, such as monuments, headstones, statuary and other stone ornaments or utilitarian items can be expensive and time consuming due to the scarcity of skilled stone carvers and the difficulty in accurately and consistently engraving or etching stone. Consequently, methods have been developed for sandblasting desired lettering or designs into a stone surface using stencils. For example, U.S. Pat. No. 3,194,153 to Rogerson discloses a rubber stencil for sandblasting memorial stones. The stencil is affixed to the stone surface is then sandblasted. The duration of the sandblasting determines the depth of the etching. The stencil protects the remainder of the stone so that only the desired letters or designs are etched into the stone surface. These rubber stencils have been used very successfully because the rubber provides the resilience necessary to withstand the harsh sandblasting environment and is thus very durable. This durability ensures that the stencil will remain intact during the sandblasting operation which in turn ensures that the letters or designs etched in the object are sharp.

Rubber stencils are, however, relatively expensive due to the high cost of natural rubber. This is due to the many difficulties inherent in processing natural rubber. Moreover, natural rubber stencils are difficult to cut precisely. Thus, efforts have been made to provide alternative materials for use in sandblasting stencils. For example, U.S. Pat. No. 3,473,941 to Hemphill discloses a resist material which may be silk-screened onto a fibrous panel such as an acoustic tile. The tile is then sandblasted to provide a textured surface. The resist is a vinyl compound made up of 100 parts resin, 100 parts plasticizer, 200 parts pigment and small amounts of stabilizers, surfactants and dispersants. Similarly, U.S. Pat. No. 3,267,621 to Meyers et al. discloses a mask for use in sandblasting glass in which a polyvinyl chloride (PVC) plastisol layer is applied directly to the glass. Both of these patents teach a stencil which is silk-screened directly to the article to be sandblasted. Thus, neither the Hemphill or Meyers et al. stencils can be removed for reuse. Moreover, in both cases, the article to be sandblasted is very fragile. Consequently, the sandblasting environment is substantially less severe than that encountered when sandblasting stone monuments. Because these stencils of Hemphill and Meyers are used only once and in relatively benign environments, those stencils need not be particularly resilient or durable.

Efforts to use PVC compounds in stencils for sandblasting stone monuments have failed because conventional formulations of PVC do not have the resilience of rubber. Consequently, previous PVC stencils suffered from "blow out," i.e., the PVC stencils wore excessively during sandblasting, resulting in etchings that were not sharp.

SUMMARY OF THE INVENTION

The present invention is a stencil which is applied to stone objects, glass or other materials to allow the sandblasting of a predetermined message or image on the surface of the object or other material. The stencil is made of a liquid plastisol layer cast onto a polyester liner. The polyester liner has an adhesive layer on the side opposite the liquid plastisol layer and is protected by a removable release film. The liquid plastisol layer is typically a polyvinyl chloride (PVC) composition.

To form the stencil, the liquid plastisol compound is cast onto the other side of the polyester liner and solidified. The resultant film may then be cut into stencils. The release film is removed, exposing the adhesive, and the stencil is applied to a object to be engraved or etched. The object is then sandblasted. The stenciled areas are etched, but the remainder of the monument is protected by the liquid plastisol layer. The present invention uses a new formulation of PVC that provides the necessary resilience for the stencil to be reusable. The formulation comprises 120 parts phthalate plasticizer and 30 parts filler (typically calcium carbonate) per 100 parts PVC resin.

PVC stencils in accordance with the present invention provide several advantages over rubber stencils. Because PVC is much easier to process than natural rubber, PVC stencils are significantly less expensive than natural rubber stencils. Also, PVC is more easily and accurately cut than natural rubber, thereby reducing waste. At the same time, PVC stencils in accordance with the present invention, unlike previous efforts to use PVC in sandblasting stencils, are just as durable, if not more so, as rubber stencils.

It is therefore an object of the present invention to provide a PVC stencil for use in sandblasting stone and other objects which exhibits a resilience and durability similar to that of natural rubber.

Another object of the invention is to provide a PVC stencil for use in sandblasting stone objects which is less expensive and easier to use than natural rubber.

Other objects, features, and advantages of the present invention will become apparent with reference to the remainder of the written portion and the drawings of this application, which are intended to exemplify and not to limit the invention.

DETAILED DESCRIPTION

Figure 2:
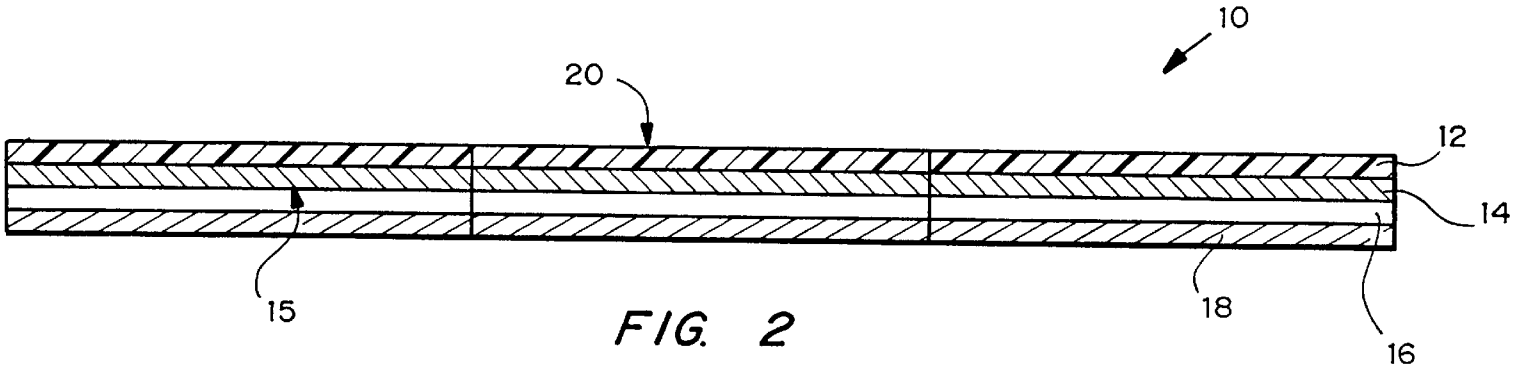
FIG. 2 is a cross-section of the stencil of FIG. 1 taken along line 2—2.
Figure 1:
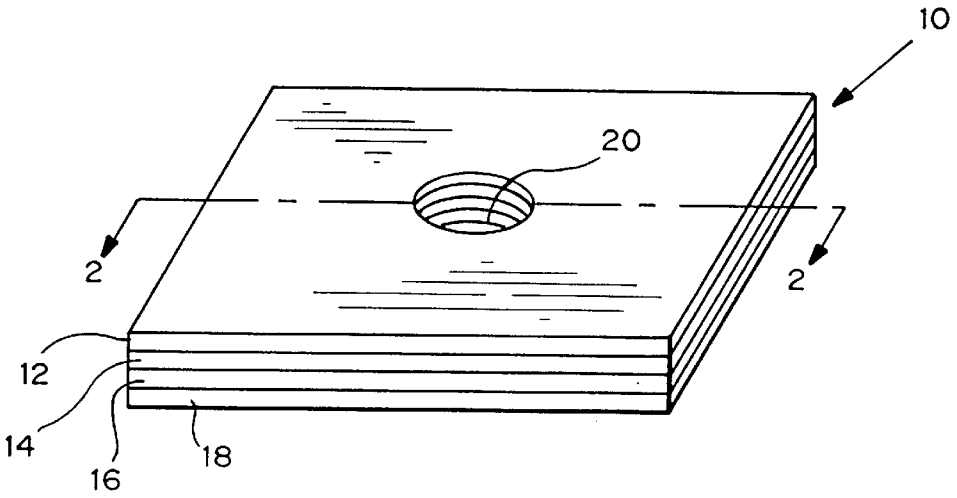
FIG. 1 is a perspective view of a sandblasting stencil in accordance with the present invention.

FIGS. 1 and 2 illustrate a stencil 10 for use in sandblasting stone and other objects. Stencil 10 comprises resist layer 12 and liner 14. Resist layer 12 is composed of a plastisol resin. In the illustrative embodiment, this layer contains a polyvinyl chloride (PVC) composition containing of about 120 parts phthalate plasticizer and about 30 parts filler (typically calcium carbonate) per 100 parts resin with small amounts of heat stabilizers (1–5 parts per 100 parts resin) and pigments (5–15 parts per 100 parts resin). These ratios may be varied while still producing stencils with satisfactory performance. At least the following ranges of ingredients have been found to yield suitable resist layers.

| | Per Hundred Weight of Resin |
|---|---|
| PVC Dispersion Resin | 60–85 |
| PVC Blending Resin | 15–40 |
| Inorganic Filler | 10–130 |
| Phthalate Ester | 80–130 |
| Heat Stabilizer | 1–5 |
| Pigment (organic or inorganic) | 5–15 |
| Epoxidised soybean oil (EPO) | 0–5 |
| Desiccant | 0–3 |

These formulations have been found to provide excellent resilience and durability when subjected to sandblasting conditions typically encountered in stone sandblasting operations. The polyvinyl chloride ("PVC") dispersion resin provides the plastic base for the stencil film. Resins suitable for use as the PVC dispersion resin include, but are not limited to, paste grade polyvinyl chloride resins. Paste grade polyvinyl chloride resins have fine particle size (0.1–2.0 microns) and are made by emulsion polymerization. Specific PVC resins which are suitable for use as this component include, but are not limited to: Geon 121, 124 and 125 sold by Geon Company, formerly part of B. F. Goodrich; VC 440 and 410M, sold by Borden, Inc.; 675F and 654H sold by Oxychem; and EH 255 and EH 219, sold by Georgia Gulf, Inc.

The polyvinyl chloride ("PVC") blending resin is a large particle-size resin which lowers costs and allows the viscosity to be controlled during processing through its effect on plasticizer absorption and particle packing. Resins suitable for use as the PVC Blending Resin, include but are not limited to suspension polymerized PVC resins, which are produced such that, during polymerization, water is the continuous phase and monomer is suspended in water. Specific PVC resins which are suitable for use as this component include, but are not limited to: Geon 217, sold by Geon Company; M70, sold by Goodyear; and VC 260, sold by Borden.

The inorganic filler is an inert inorganic material which is added to the resin during processing. Inert, as used herein, means that the filler does not react with any of the other resin components. Any inorganic material known to those skilled in the art can be used in the present resin, as long as it does not adversely impact the final properties of the resin. The inorganic filler can be used to decrease the cost of the resin, control the viscosity of the resin during processing and to increase the hardness of the resin. The amount of the inorganic filler can be varied to control these properties, as known to those skilled in the art. Suitable inorganic fillers include, but are not limited to: calcium carbonate, silicon dioxide, talc, clay, calcium silicates, barium sulfate, magnesium silicate, and kaolin.

The PVC resin composition also preferably contains plasticizers, which add softness, flexibility and processability to the resins. Those plasticizers which are known to those skilled in the art to be useful with PVC compounds can be used in the present resins. A preferred class of plasticizers are phthalate esters. Non-limiting examples of these compounds include: di-isononyl phthalate, di-hexyl phthalate, di-isodecyl phthalate and butyl benzyl phthalate. Other plasticizers such as adipates, azelates, benzoates, and citrates, could also be used with some degradation in properties and increased expense.

The resin should also contain a heat stabilizer, which prevents degradation of the polymers during processing. Any heat stabilizer known to those skilled in the art is suitable for use in the present resin compositions. Preferred heat stabilizers are metal based heat stabilizers, such as those containing calcium, barium, cadmium, tin or lead. Non-limiting examples of suitable heat stabilizers include: dibutyl tin, Vanstay 8586 and Thermchek 139 available from R. T. Vanderbilt. Epoxidised soybean oil or "EPO" also may be used as both a heat stabilizer and plasticizer during processing plasticization.

Bubbles or voids in the final product may appear if there is any water in the raw materials. These are due to vaporization of water during processing. Thus, it also may be desirable to include a desiccant, such as calcium oxide or other appropriate compounds, to bind any water which may be present in the raw materials.

The ideal thickness of resist layer 12 may be selected based on the anticipated sandblasting environment. For example, a resist layer 12 thickness of about 20 mils has been found to provide adequate performance under normal stone monument sandblasting conditions. Moreover, thicknesses of up to about 70 mils have also been used successfully. Other thicknesses may be selected as desired or appropriate.

Liner 14 may have adhesive layer 16 applied on side 15 opposite resist layer 12. Release film 18 may be applied to adhesive layer 16 to protect the adhesive prior to use. Liner 14 may be any suitable material which provides a stable base on which to cast layer 12, and is typically a plastic film such as a polymer sheet such as a polyester sheet of about two to five mils in thickness. Polyester in particular is desirable because it is easily handled and cut; however, other polymer sheets may also be used, such as polyolefins and other known polymers, many of which are also easily handled and cut. More particularly, it has been found that adhesive paper number P616, available from Coating Sciences, 111 Great Pond Drive, Windsor, Conn. 06095 is a suitable material for use as liner 14. P616 may be purchased already bearing adhesive layer 16 and release film 18.

To form stencil 10, the liquid plastisol compound (e.g., in the pre-formulation described above) is formulated. The order of addition of materials during mixing of the vinyl compound is important for adequate dispersion. The pigments and blowing agent require pre-dispersion to ensure complete color development of the pigment and the finest possible particle size of the blowing agent for cell size consistency. The resins and fillers should be blended into 75% of the plasticizer for high shear during mixing to break down all dry agglomerates before the remaining plasticizer is added. Without proper agglomerate breakdown, there will be poor viscosity control and poor cell size consistency. The diarylide yellow should be pre-dispersed and milled to its minimum particle size, which particle size is approximately 0.1 micron.

The liquid plastisol is then cast by a doctor roll onto the side of liner 14 opposite adhesive layer 14 and release film 18. Other casting techniques or methods of applying the liquid plastisol compound to liner 14 may also be used as desired or appropriate. Viscosity control of the plastisol is necessary for proper casting and curing. This may be accomplished through the use of viscosity modifiers. Any viscosity modifier known to those skilled in the art can be used in the present resins. Non-limiting examples of suitable viscosity modifiers include: fumed silica, sold by Degussa; and BYK010, sold by BYK Chemie.

Temperature stability of the plastisol is critical. Inadequate stability will permit degradation of the polyvinyl chloride yielding loss of desired physical properties, discoloration, and general of hydrogen chloride. Plastisol temperature stability is achieved through resin choice, pigment choice and the use of heat stabilizers. Temperature stability is achieved by: (a) Resin choice—some resins have residual emulsifiers present which can decrease heat stability. (b) Pigment choice—some pigments are more thermally stable than others due to their chemical structure. (c) Heat stabilizers—these prevent degradation and color change y scavenging HCL which is generated during thermal breakdown of PVC.

Fusion temperatures and speeds must be optimized to ensure consistent cure of the stencil film. This optimization is accomplished by controlling the oven temperature and the dwell time of the resin in the oven. Oven temperature is controlled by thermostats which correct for temperature fluctuations during the processing. The temperatures required range between 340° and 450° F. The dwell time in the oven is determined by the time required to bring the entire mat up to this temperature range. That time is dependent on the temperature of the incoming material, the mass of material being processed at one time, and the ability of the oven to quickly compensate for temperature loss due to these factors.

During the curing process, the plasticizer and resin chemically bond, thus converting the liquid plastisol compound into a solid, forming resist layer 12. The resultant film may then be cut into stencils. For example, a design 20 may be cut through stencil 10. The stencils may be cut by hand or on stencil cutters. The release film is then removed to expose the adhesive and the stencil is applied to the object to be etched. The object is then sandblasted. Typical sandblasting conditions, i.e., pressure and grit, vary greatly depending on the characteristics of the substrate being etched. For example, pressures and grits for etching marble and granite may be substantially higher than those used for etching glass. Stencils according to the present invention have been found to perform satisfactorily under the full range of conditions typically encountered in sandblasting operations. The open areas of the stencil are etched in the object, e.g., design 20 is etched into the surface of the object, but the remainder of the object is protected by the closed areas of the stencil and in particular by resist layer 12. Example:

One embodiment of the present invention is made using the P616 paper described above. A plastisol having the following formulation is applied by doctor rolls.

| | Per Hundred Weight of Resin |
|---|---|
| DINP | 120 |
| Calcium Oxide | 0.2 |
| Titanium Dioxide | 5.0 |
| Dibutyl Tin Stabilizer | 2.0 |
| Fumed Silica | 1.0 |
| PVC Blending Resin (GEON 213) | 30.0 |
| PVC Dispersion Resin (GEON 212AR) | 70.0 |
| Calcium Carbonate | 30.0 |

The viscosity of the plastisol is about 6–10 CPS @ 20 rpm. The plastisol is applied to the paper at a coating weight of 34 ounces per square yard at a gauge of between 0.03701 and 0.04301 with the optimum gauge of about 0.04010. The line speed is about seventeen feet per minute. Three temperature zones are used. The first temperature zone is about 460 degrees Fahrenheit, the second about 370 degrees Fahrenheit and the third about 440 degrees Fahrenheit.

The foregoing is provided for purposes of illustration, explanation, and description of embodiments of the present invention. Modifications and adaptations to these embodiments will be apparent to those skilled in the art and may be made without departing from the scope or spirit of the invention.

I claim:

1. An abrasion resist layer comprising:

a) polyvinyl chloride resin;

b) a plasticizer wherein the plasticizer is selected from the group consisting of diallcyl phthalate ester, phthalic acid anhydride, di-isononyhl phthalate, di-hexyl phthalate, di-isodecyl phthalate, butyl benzyl phthalate, adipates, azelates, benzoates and citrates; and c) an inorganic filler.

2. The abrasion resist layer according to claim 1 wherein the plasticizer is present in an amount of about 80 to 130 parts based on 100 parts polyvinyl chloride resin.

3. The abrasion resist layer according to claim 1 wherein the inorganic particulate filler is selected from the group consisting of calcium carbonate, silicon dioxide, talc, clay, calcium silicates, barium sulfate, magnesium silicate, and kaolin.

4. The abrasion resist layer according to claim 1 wherein the inorganic particulate filler is present in an amount of about 10 to 50 parts based on 100 parts polyvinyl chloride resin.

5. The stencil of claim 1 in which the resist layer defines at least one hole.

6. An abrasion resistant stencil, comprising:

a) the abrasion resist layer according to claim 1; and b) a polymeric liner disposed on a surface of the abrasion resist layer.

7. The abrasion resistant stencil according to claim 6, further comprising:

c) an adhesive layer disposed on a surface of the polymeric layer opposite the abrasion resist layer.

8. The abrasion resistant stencil according to claim 7 further comprising a release film disposed on a surface of the adhesive layer opposite the polymeric liner.

9. The abrasion resistant stencil according to claim 6, wherein the polymeric liner is a plastic film.

10. The abrasion resistant stencil according to claim 9, wherein the plastic film comprises a polymer selected from the group consisting of polyesters and polyolefins.

11. A method for forming a stencil for use in sandblasting stone objects comprising the steps of:

a) preparing a liquid plastisol composition comprising a resin, a plasticizer, and an inorganic particulate filler in amounts of about 120 parts plasticizer and about 30 parts filler per 100 parts resin;

b) casting the plastisol compound into a flat layer; and c) curing the plastisol compound to create a resin film.

12. The method of claim 11 in which the step of casting the plastisol compound is performed by casting the compound onto a liner.

13. The method of claim 11 further comprising the step of cutting at least one hole in the film.

14. An abrasion resist layer comprising:

a) polyvinyl chloride resin;

b) a plasticizer; and c) an inorganic filler wherein the inorganic filler is selected from the group consisting of calcium carbonate, silicon dioxide, talc, clay, calcium silicates, barium sulfate, magnesium silicate, and kaolin.

* * * * *

UNITED STATES PATENT AND TRADEMARK OFFICE

CERTIFICATE OF CORRECTION

PATENT NO. : 5,980,362
DATED : November 9, 1999
INVENTOR(S) : Hensler

It is certified that error appears in the above-identified patent and that said Letters Patent is hereby corrected as shown below:

Column 5,
Line 60, delete "diallcyl" and insert -- diallyl --.

Column 6,
Line 1, delete "di-isononyhl" and insert -- di-isononyl --.

Signed and Sealed this

Twenty-third Day of October, 2001

*Attest:*

Nicholas P. Godici

*Attesting Officer*

NICHOLAS P. GODICI
*Acting Director of the United States Patent and Trademark Office*